US010144901B2

(12) United States Patent
Khan et al.

(10) Patent No.: US 10,144,901 B2
(45) Date of Patent: Dec. 4, 2018

(54) LUBRICANT COMPOSITION FOR LAPPING CERAMIC MATERIAL, AND RELATED METHODS

(71) Applicant: Seagate Technology LLC, Cupertino, CA (US)

(72) Inventors: Zubair Ahmed Khan, Villa Park, IL (US); Joel W. Hoehn, Hudson, WI (US); Peter John Gunderson, Ellsworth, WI (US)

(73) Assignee: Seagate Technology LLC, Cupertino, CA (US)

( * ) Notice: Subject to any disclaimer, the term of this patent is extended or adjusted under 35 U.S.C. 154(b) by 316 days.

(21) Appl. No.: 15/043,986

(22) Filed: Feb. 15, 2016

(65) Prior Publication Data

US 2017/0233677 A1 Aug. 17, 2017

(51) Int. Cl.

| | |
|---|---|
| ***B24B 1/00*** | (2006.01) |
| ***C10M 169/04*** | (2006.01) |
| ***C10M 105/14*** | (2006.01) |
| ***C10M 147/02*** | (2006.01) |

(52) U.S. Cl.

CPC ..... *C10M 169/041* (2013.01); *C10M 105/14* (2013.01); *C10M 147/02* (2013.01); *C10M 2207/0225* (2013.01); *C10M 2213/02* (2013.01); *C10N 2230/08* (2013.01)

(58) Field of Classification Search

CPC ..... B24B 1/00

USPC ..... 451/28, 41, 36, 449, 450

See application file for complete search history.

(56) References Cited

U.S. PATENT DOCUMENTS

| | | | | |
|---|---|---|---|---|
| 5,591,073 | A * | 1/1997 | Turgeon | B24B 19/26 451/314 |
| 6,465,398 | B1 * | 10/2002 | Arnold | C09G 3/00 106/270 |
| 7,275,311 | B2 | 10/2007 | Markevitch et al. | |
| 7,410,410 | B2 | 8/2008 | Mahadev et al. | |
| 7,964,541 | B2 | 6/2011 | Matsunaga et al. | |
| 8,057,697 | B2 | 11/2011 | Lombardi | |
| 2008/0176779 | A1 * | 7/2008 | Matsunaga | C10M 141/06 508/548 |
| 2010/0317262 | A1 * | 12/2010 | Boutaghou | B24D 18/0009 451/41 |
| 2011/0239444 | A1 * | 10/2011 | Fukuoka | B24B 37/11 29/603.16 |
| 2014/0170944 | A1 | 6/2014 | Moudry et al. | |

* cited by examiner

*Primary Examiner* — Robert Rose
(74) *Attorney, Agent, or Firm* — Kagan Binder, PLLC

(57) ABSTRACT

Disclosed herein are embodiments of a method of making a lubricant composition for lapping a ceramic material. The method includes mixing a base lubricant component and a powdered wax composition component to form the lubricant composition. The powdered wax composition component includes a powdered wax dispersion or a powdered wax emulsion. The amount of powdered wax composition component mixed with the base lubricant component is from 0.01 to 10 percent by weight of the lubricant composition. Also disclosed herein are embodiments of related lubricant compositions and/or methods of using the lubricant to lap a ceramic substrate (e.g., one or more bars of sliders).

23 Claims, 1 Drawing Sheet

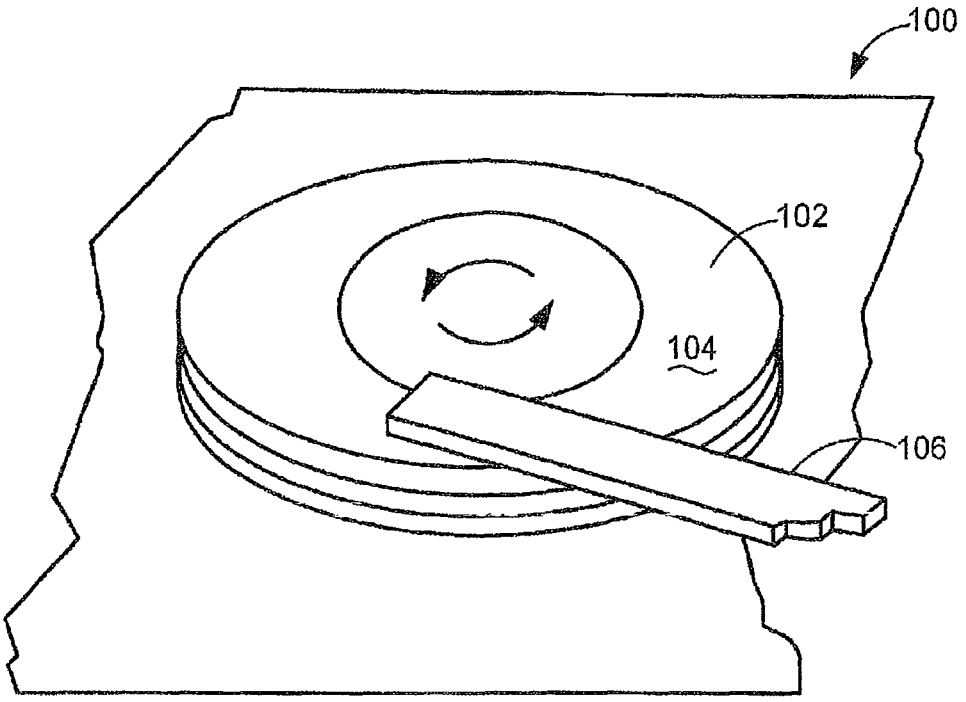
100
102
104
106

LUBRICANT COMPOSITION FOR LAPPING CERAMIC MATERIAL, AND RELATED METHODS

FIELD

Embodiments of the present disclosure relate to lubricant compositions for lapping a surface of one or more slider bars (e.g., one or more slider bars made of AlTiC).

BACKGROUND

Lapping one or more bars of sliders for the hard disk drive (HDD) industry can involve contacting a surface of the one or more bars with a surface of a rotating lapping plate so as to remove material from the surface of the one or more bars and provide a desired surface. Abrasive material can be used to help abrade the material from the one or more bars. Abrasive material can be fixed to the lapping plate and/or be dispensed onto the surface of the lapping plate (e.g., as an abrasive slurry) during lapping.

FIG. 1 diagrammatically depicts a lapping tool 100 used for machining a surface of a slider. The tool 100 has a rotating lapping plate 102 defining a lapping surface 104 which can help abrade the surface of a ceramic material such as AlTiC. If desired, an abrasive slurry can be applied to the lapping surface 104 to enhance the abrading action as the lapping surface 104 is rotated relative to a slider bar 106 containing a plurality of the sliders held in a pressing engagement against the lapping surface 104. A lapping plate can be used for a variety of lapping processes such as rough lapping, fine lapping, and kiss lapping.

Also, a lubricant composition, which is separate from any abrasive slurry, can be applied to the lapping surface 104 during lapping to facilitate one or more of removing heat from the one or more bars during lapping, lubricating the interface between any abrasive materials and the surface of the one or more bars being lapped, and removing "swarf" from the at least a portion of the one or more bars being lapped and/or at least the portion of the lapping plate that contacts the one or more bars being lapped. As used herein, "swarf" refers to filings/shavings of material (e.g., ceramic material) removed from the one or more bars being lapped by the abrading action of the lapping plate.

There is a continuing desire to find alternative lubricant compositions for lapping slider bars.

SUMMARY

Disclosed herein are embodiments of a method of making a lubricant composition for lapping a ceramic material, wherein the method includes mixing a base lubricant component and a powdered wax composition component to form the lubricant composition. The powdered wax composition component includes a powdered wax dispersion or a powdered wax emulsion. The amount of powdered wax composition component mixed with the base lubricant component is from 0.01 to 10 percent by weight of the lubricant composition.

Also disclosed herein are embodiments of a lubricant composition for lapping a ceramic material. The lubricant composition includes a) a base lubricant; and b) a powdered wax. The powdered wax is present as a dispersion or emulsion in the base lubricant. The powdered wax is from 0.003 to 7 percent by weight of the lubricant composition.

Also disclosed herein are embodiments of a method of lapping a ceramic substrate. The method includes: a) dispensing a lubricant composition in a manner so that at least a portion of the lubricant composition contacts a surface of a ceramic substrate, and b) lapping the surface of the ceramic substrate with a lapping plate. The lubricant composition includes i) a base lubricant; and ii) a powdered wax. The powdered wax is present as a dispersion or emulsion in the base lubricant. The powdered wax is from 0.003 to 7 percent by weight of the lubricant composition.

BRIEF DESCRIPTION OF THE DRAWINGS

FIG. 1 is a schematic perspective view showing a prior art lapping plate in a portion of a lapping tool.

DETAILED DESCRIPTION

A—Method of Making a Lubricant Composition

A lubricant composition for lapping a ceramic material can be made by mixing a base lubricant component and a powdered wax composition component to form the lubricant composition.

A.1 Powdered Wax Composition Component

A powdered wax composition component according to the present disclosure can include a powdered wax composition of a type and amount so as to help remove swarf from the area that a lapping plate is in abrading contact with one or more bars to be lapped. Powdered wax compositions include a powdered wax dispersion, a powdered wax emulsion, and combinations thereof.

A powdered wax dispersion refers to a plurality of wax particles in solid, powdered form that are dispersed in a liquid phase (e.g., an organic liquid phase, an aqueous liquid phase (e.g., water), and mixtures thereof). In some embodiments, a powdered wax dispersion includes a plurality of wax particles in solid, powdered form that are dispersed in only water. In some embodiments, the powdered wax particles in a powdered wax dispersion can have an average particle diameter of from 0.5 to 10 microns, from 0.75 microns to 5 microns, or even from 1 to 4 microns. In some embodiments, a powdered wax dispersion can have a solids content of from 30 to 70 percent, from 35 to 65 percent, or even from 40 to 60 percent.

A powdered wax emulsion refers to a plurality of wax particles in solid, powdered form that are dispersed in an emulsion, where the emulsion is a first liquid phase that is dispersed in a second liquid phase that is compositionally different from the first liquid. For example, the emulsion can be an oil-in-water emulsion that is an organic liquid phase (first liquid phase) that is dispersed in an aqueous phase (second liquid phase). An exemplary organic liquid phase can be one or more fatty acids. Alternatively, the second liquid phase could be dispersed in the first liquid phase.

The chemistry of the powdered wax can selected to facilitate removing a desirable amount of swarf per unit time while being compatible with the lapping plate and bars to be lapped. For example, as mentioned below, while not being bound by theory, a powdered wax can be selected based on its electronegative characteristics so as to repel swarf from a bar and/or lapping plate as the swarf is being generated. In some embodiments, a powdered wax is selected from the group consisting of powdered paraffin wax, powdered polytetrafluoroethylene wax, powdered polyethylene wax, powdered polypropylene wax, and combinations thereof. Such wax powders can be used to make related powdered wax compositions such as a powdered wax dispersion or a powdered wax emulsion. In some embodiments, the powdered wax composition includes a powdered polytetrafluoroethylene (PTFE) dispersion. While not being bound, it is believed that electronegativity of PTFE helps repel swarf (especially swarf from an AlTiC substrate) away from the bar that is being lapped.

In some embodiments, the amount of powdered wax composition that is mixed with base lubricant can be from 0.005 to 10 percent by weight of the lubricant composition, from 0.01 to 5 percent by weight of the lubricant composition, or even from 0.1 to 4 percent by weight of the lubricant composition. An example of a useful powdered wax composition according to the present disclosure is a PTFE powdered wax dispersed in water and commercially available under the tradename AquaFLON® 60 from Shamrock Technologies, Inc., Newark, N.J.

A.2 Base lubricant Component

A base lubricant component according to the present disclosure can include a single base lubricant composition or a mixture of different base lubricant compositions. The base lubricant component can be selected to be compatible with the powdered wax composition so that the powdered wax composition is uniformly distributed throughout the base lubricant component, while at the same time providing one or more desirable properties for lapping such as lubrication, heat dissipation, and the like.

In some embodiments, the base lubricant component includes a base lubricant selected from the group consisting of an aqueous base lubricant, an organic base lubricant, and combinations thereof. Examples of organic base lubricants include alcohols (e.g., alkene diols), petroleum distillates, mineral oils, vegetable oils, esters, amines, combinations of these, and the like. Exemplary alkene diols include ethylene glycol, propylene glycol, and combinations thereof. In some embodiments, a base lubricant component includes a mixture of water and ethylene glycol. The base lubricants can be selected to be electronic grade.

If a base lubricant component includes an aqueous base lubricant and an organic base lubricant, the weight ratio of aqueous base lubricant to organic base lubricant can be in the range from 1:1 to 1:5, from 1:1.5 to 1:4, or even from 1:2 to 1:3. In some embodiments, the amount of base lubricant component that is mixed with the powdered wax composition can be from 90-99.99 percent by weight of the lubricant composition.

A3. Optional Additives

Optionally, a lubricant composition may include one or more additives suitable for use in a lubricant composition to be used in a lapping process.

A.4 Mixing the Base Lubricant Component and the Powdered Wax Composition Component to Form the Lubricant Composition The base lubricant and powdered wax composition can be combined in any suitable manner to form a lubricant composition. For example, a high speed mixer such as those known in the art can be used to mix the base lubricant and powdered wax composition together to form a lubricant composition.

The lubricant composition made from mixing the powdered wax composition component and the base lubricant component can be used for lapping a ceramic material. Accordingly, the lubricant composition includes one or more base lubricants from the base lubricant component and one or more powdered waxes from the powdered wax composition component.

In the lubricant composition, the powdered wax can be present as a dispersion or emulsion in the base lubricant. In some embodiments, the amount of the powdered wax that is present in the final lubricant composition can be from 0.0015 to 7 percent by weight of the lubricant composition, or even from 0.003 to 7 percent by weight of the lubricant composition. In some embodiments, the amount of base lubricant in the final lubricant composition is from 93-99.997 percent by weight of the lubricant composition.

An exemplary formulation (wt. %) for a lubricant composition according to the present disclosure is as follows:

Ethylene glycol 60-70%;

PTFE dispersion 0.01 to 0.1%; and the balance water.

B—Method of Lapping a Ceramic Substrate Using the Lubricant Composition

A lubricant composition as described herein can be used to lap a ceramic substrate. A method of lapping includes a) dispensing the lubricant composition in a manner so that at least a portion of the lubricant composition contacts a surface of a ceramic substrate, and b) lapping the surface of the ceramic substrate with a lapping plate. This process can be repeated for additional substrates (e.g., additional bars of sliders) using the same lapping plate. In some embodiments, the lapping process can be repeated for an additional 1, 2, 3, 4, 5, 6, or even more bars of sliders using the same lapping plate.

In some embodiments, the ceramic substrate is made of material comprising a two-phase mixture of alumina and titanium-carbide (also referred to as "AlTiC"). An example of an AlTiC substrate is one or more bars of sliders. The bar of sliders includes a plurality of individual sliders, where each slider includes an air-bearing surface. In hard disc drives, the air bearing surface of a slider (also known as a read/write head) can include a transducer that can read information from and write information to a rotating computer hard disk drive.

It is noted that increasing the number of bars of sliders that are lapped per plate can increase the amount of swarf that is generated per unit time, which can adhere to the lapping plate and build up to an undue degree thereby decreasing lapping plate-life, increasing scratching of the surface of the bar being lapped, and the like. In some embodiments, the lapping surface of a lapping plate can include electrically conductive materials such as tin, bismuth, and the like, which can attract oppositely charged swarf, thereby exacerbating the problem of increased volumes of swarf when lapping more bars per lapping plate.

Advantageously, by using a lubricant composition having a powder wax according to the present disclosure, the swarf can be repelled from the bar and/or lapping plate in a desirable manner so that the number of bars lapped per lapping plate can be increased (e.g., up to 3, 4, 5, 6, 7, 8, or even more bars per plate) without swarf building up to an undue degree so as to cause an intolerable amount of scratching of a reader portion and/or a writer portion of a slider. In some embodiments, while not being bound by theory, it is believed that swarf carries a negative charge and a powdered wax composition can have a sufficient electronegative character and/or lubricity to repel and dissipate swarf to the sides of bar so that swarf does not adhere to plate to an undue degree. An additional advantage is that silica is not necessary and can be avoided in the lubricant composition if desired. For example, silica can build up on a component being lapped and cause electrical performance degradation to an undue degree.

Abrasive material used in lapping can be fixed on the surface of a lapping plate and/or can be dispensed onto the surface of the lapping plate during lapping, e.g., as an abrasive slurry.

Methods of lapping sliders are also disclosed in published U.S. Pat. No. 7,275,311 (Markevitch et al.); U.S. Pat. No.

7,410,410 (Mahadev et al.); and 2014/0170944 (Moudry et al.), wherein the entirety of each of said patent document is incorporated herein by reference.

What is claimed is:

1. A method of making a lubricant composition for lapping a ceramic material, wherein the method comprises mixing a base lubricant component and a powdered wax composition component to form the lubricant composition, wherein the powdered wax composition component comprises a powdered wax dispersion or a powdered wax emulsion, and wherein the amount of powdered wax composition component mixed with the base lubricant component is from 0.01 to 10 percent by weight of the lubricant composition.

2. The method of claim 1, wherein the base lubricant component comprises a base lubricant selected from the group consisting of an aqueous base lubricant, an organic base lubricant, and combinations thereof, and wherein the amount of base lubricant component mixed with the powdered wax composition component is from 90-99.99 percent by weight of the lubricant composition.

3. The method of claim 1, wherein the base lubricant component comprises an alkene diol and water.

4. The method of claim 1, wherein the powdered wax composition component comprises a powdered wax composition selected from the group consisting of a powdered paraffin composition, a powdered polytetrafluoroethylene composition, a powdered polyethylene composition, a powdered polypropylene composition, and combinations thereof.

5. The method of claim 4, wherein the powdered wax composition component comprises a powdered polytetrafluoroethylene dispersion.

6. The method of claim 5, wherein the powdered polytetrafluoroethylene dispersion comprises 30-70 percent solids.

7. A lubricant composition for lapping a ceramic material, the lubricant composition comprising:

a) a base lubricant, wherein the base lubricant is present in an amount from 93-99.997 percent by weight of the lubricant composition, and wherein the base lubricant comprises at least one alkene diol; and b) a powdered wax, wherein the powdered wax is present as a dispersion or emulsion in the base lubricant, and wherein the powdered wax is from 0.003 to 7 percent by weight of the lubricant composition.

8. The lubricant composition of claim 7, wherein the at least one alkene diol is chosen from ethylene glycol, propylene glycol, and mixtures thereof.

9. The lubricant composition of claim 7, wherein the base lubricant further comprises water.

10. The lubricant composition of claim 9, wherein the powdered wax is selected from the group consisting of a powdered paraffin, a powdered polytetrafluoroethylene, a powdered polyethylene, a powdered polypropylene, and combinations thereof.

11. The lubricant composition of claim 10, wherein the powdered wax comprises powdered polytetrafluoroethylene.

12. A method of lapping a ceramic substrate, the method comprising:

a) dispensing a lubricant composition in a manner so that at least a portion of the lubricant composition contacts a surface of a ceramic substrate, wherein the lubricant composition comprises:

i) a base lubricant; and ii) a powdered wax, wherein the powdered wax is present as a dispersion or emulsion in the base lubricant, and wherein the powdered wax is from 0.003 to 7 percent by weight of the lubricant composition; and b) lapping the surface of the ceramic substrate with a lapping plate.

13. The method of claim 12, the wherein the powdered wax is present as a dispersion or emulsion in the base lubricant.

14. The method of claim 12, wherein the base lubricant is selected from the group consisting of an aqueous base lubricant, an organic base lubricant, and combinations thereof, and wherein the base lubricant is present in an amount from 93-99.997 percent by weight of the lubricant composition.

15. The method of claim 14, wherein the base lubricant comprises an alkene diol and water.

16. The method of claim 12, wherein the powdered wax is selected from the group consisting of a powdered paraffin, a powdered polytetrafluoroethylene, a powdered polyethylene, a powdered polypropylene, and combinations thereof.

17. The method of claim 16, wherein the powdered wax comprises powdered polytetrafluoroethylene.

18. The method of claim 12, wherein the ceramic substrate is made of material comprising a two-phase mixture of alumina and titanium-carbide.

19. The method of claim 12, wherein the ceramic substrate is a bar of sliders.

20. The method of claim 19, wherein the surface of the bar of sliders comprises a plurality of air-bearing surfaces.

21. The method of claim 1, wherein the base lubricant comprises at least one alkene diol.

22. The method of claim 21, wherein the at least one alkene diol is chosen from ethylene glycol, propylene glycol, and mixtures thereof.

23. The method of claim 12, wherein the base lubricant comprises at least one alkene diol.

* * * * *